US010188936B2

(12) United States Patent
Back et al.

(10) Patent No.: US 10,188,936 B2
(45) Date of Patent: Jan. 29, 2019

(54) SIDED GAME ACCESSORY DEVICE

(71) Applicants: Nimrod Back, Tel Aviv (IL); Saar Shai, Kochav Yair (IL)

(72) Inventors: Nimrod Back, Tel Aviv (IL); Saar Shai, Kochav Yair (IL)

( * ) Notice: Subject to any disclaimer, the term of this patent is extended or adjusted under 35 U.S.C. 154(b) by 20 days.

(21) Appl. No.: 15/204,193

(22) Filed: Jul. 7, 2016

(65) Prior Publication Data

US 2017/0007917 A1 Jan. 12, 2017

Related U.S. Application Data

(60) Provisional application No. 62/189,253, filed on Jul. 7, 2015.

(51) Int. Cl.
*A63F 9/24* (2006.01)
*A63F 9/04* (2006.01)

(52) U.S. Cl.
CPC ..... *A63F 9/0468* (2013.01); *A63F 9/24* (2013.01); *A63F 9/0413* (2013.01); *A63F 2009/0491* (2013.01); *A63F 2009/2432* (2013.01); *A63F 2009/2454* (2013.01); *A63F 2009/2482* (2013.01); *A63F 2009/2485* (2013.01); *A63F 2009/2488* (2013.01)

(58) Field of Classification Search
None
See application file for complete search history.

(56) References Cited

U.S. PATENT DOCUMENTS 5,362,052 A * 11/1994 Kubatsch ..... A63F 9/04 273/138.2
2009/0210101 A1* 8/2009 Hawkins ..... A63F 9/04 700/297
2009/0224475 A1* 9/2009 Hsu ..... A63F 9/0402 273/146
2010/0032896 A1* 2/2010 Berlec ..... A63F 9/0402 273/146
2012/0163520 A1* 6/2012 Liu ..... G01S 5/0018 375/356
2012/0223477 A1* 9/2012 Zylkin ..... A63F 9/0468 273/146
2012/0232780 A1* 9/2012 Delson ..... A63F 13/06 701/400
2013/0217295 A1* 8/2013 Karunaratne ..... A63H 33/086 446/124
2014/0376876 A1* 12/2014 Bentley ..... A63F 13/00 386/227

* cited by examiner

*Primary Examiner* — Paul A D'Agostino
(74) *Attorney, Agent, or Firm* — Benjamin Appelbaum

(57) ABSTRACT

A device that is an accessory for or a component of games, such as tabletop games, board games, card games and the like includes an actuator, a microprocessor and a power source, and one or more of a timer, sound sensor, light emitter, sound emitter, orientation sensor, motion sensor, optical sensor, communicator, charger and randomizer. The device is programmed through sound transmitted from an external source, such as a computer. The device responds to sounds such as voice commands, hand claps, or other types of sound by a series of programmed behaviors that include rolling, jumping, bouncing and/or displaying one or more lights. When embodied as a die or other sided object, the actuator is mounted at an angle with respect to the device sides. Alternate embodiments could be configured in the shape of a character, such as an animal, person, design of a fictional character or the like.

11 Claims, 5 Drawing Sheets

SIDED GAME ACCESSORY DEVICE

CROSS-REFERENCE TO RELATED APPLICATIONS

This application claims the benefit of United States Provisional Application for Patent, Ser. No. 62/189,253, filed 7 Jul. 2015, by the present inventors, and whose contents are incorporated by reference herein in their entirety.

FIELD OF THE INVENTION

The present invention is in the technical field of games. More particularly, the present invention is in the technical field of accessories and components in games, such as dice, timers, pawns, bells, etc.

BACKGROUND OF THE INVENTION

Conventional accessories in games are passive, i.e., they do not include an actuator or cannot operate without direct human interaction. Additionally, conventional accessories can perform only 1 or 2 actions, such as randomizing values (e.g. dice) or keeping time (e.g. hourglass), denote locations (e.g. meeples or pawns), denote events (e.g. bells). Such limitations prevent the development of certain games, or make the experience of playing some games less fun and more cumbersome.

BRIEF SUMMARY OF THE INVENTION

The present invention is a sided device, such as a six sided die, that includes an actuator for physical motion, such as motion that rotates, turns, flips and/or lifts the object from a surface.

In some embodiments, the sided device includes an electronic timer which can control the actuator, such as by activating it or deactivating it.

In some embodiments, the sided device includes a sound sensor which can control the actuator and/or the electronic timer.

In some embodiments, the sided device includes a light emitter (e.g. a light emitting diode, "LED") or a sound emitter (e.g. speaker) which can be controlled by the timer and/or the sound sensor.

In some embodiments, the sided device includes an orientation sensor which can detect the orientation of the sided object, such as on which side the device is positioned.

In some embodiments, the actuator for physical motion is positioned diagonally to any one or more sides of the sided device, in one or more geometric planes.

In some embodiments, the sided device includes a randomizer which can generate or produce random values for any processing or computation in the device.

Embodiments of the present invention include a device that is an accessory for or a component of games, such as tabletop games, board games, card games and the like includes an actuator, a microprocessor and a power source, and one or more of a timer, sound sensor, light emitter, sound emitter, orientation sensor, motion sensor, optical sensor, communicator, charger and randomizer. The device is programmed through sound transmitted from an external source, such as a computer. The device responds to sounds such as voice commands, hand claps, or other types of sound by a series of programmed behaviors that include rolling, jumping, bouncing and/or displaying one or more lights. When embodied as a die or other sided object, the actuator is mounted at an angle with respect to the device sides. Alternate embodiments could be configured in the shape of a character, such as an animal, a person, a design of a fictional character or the like.

BRIEF DESCRIPTION OF THE SEVERAL VIEWS OF THE DRAWINGS

A clear understanding of the key features of the invention summarized above may be had by reference to the appended drawings, which illustrate the system and method system of the present invention, although it will be understood that such drawings depict exemplary embodiments of the present invention and, therefore, are not to be considered as limiting its scope with regard to other embodiments which the present invention is capable of contemplating. Accordingly.

DETAILED DESCRIPTION OF THE INVENTION

Figure 1:
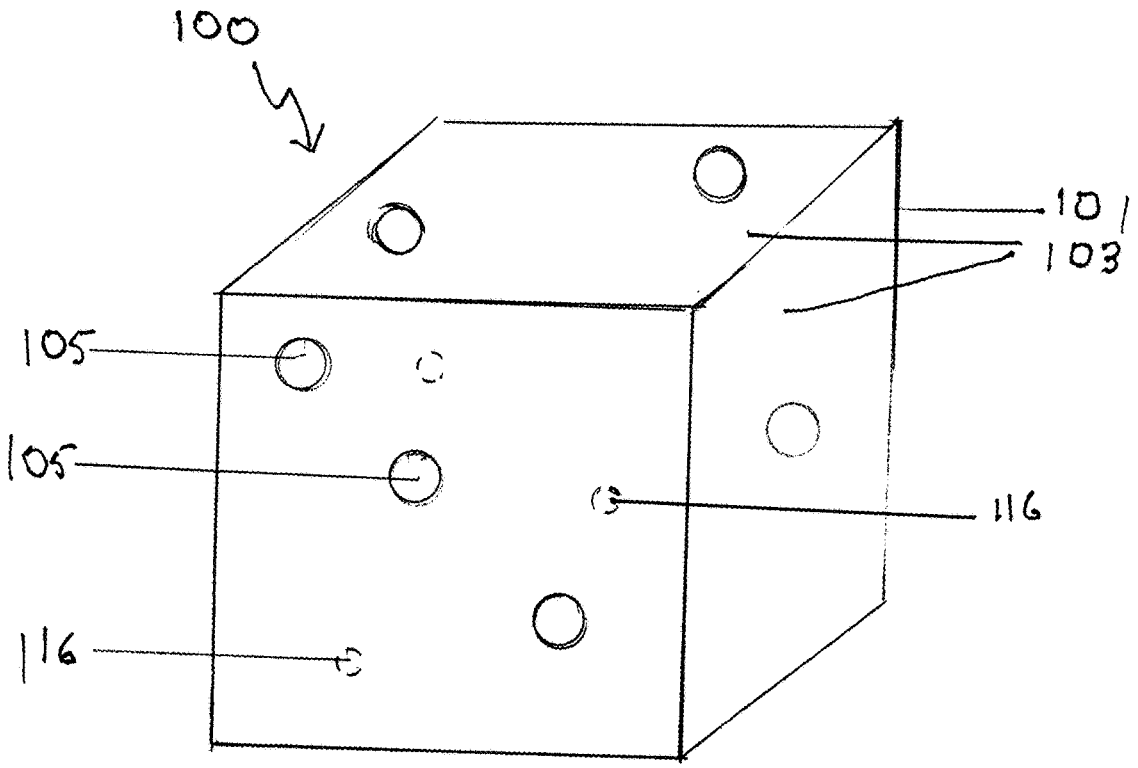
FIG. 1 is an illustration of an embodiment of the present invention; light emitting diodes are shown in phantom.
Figure 2:
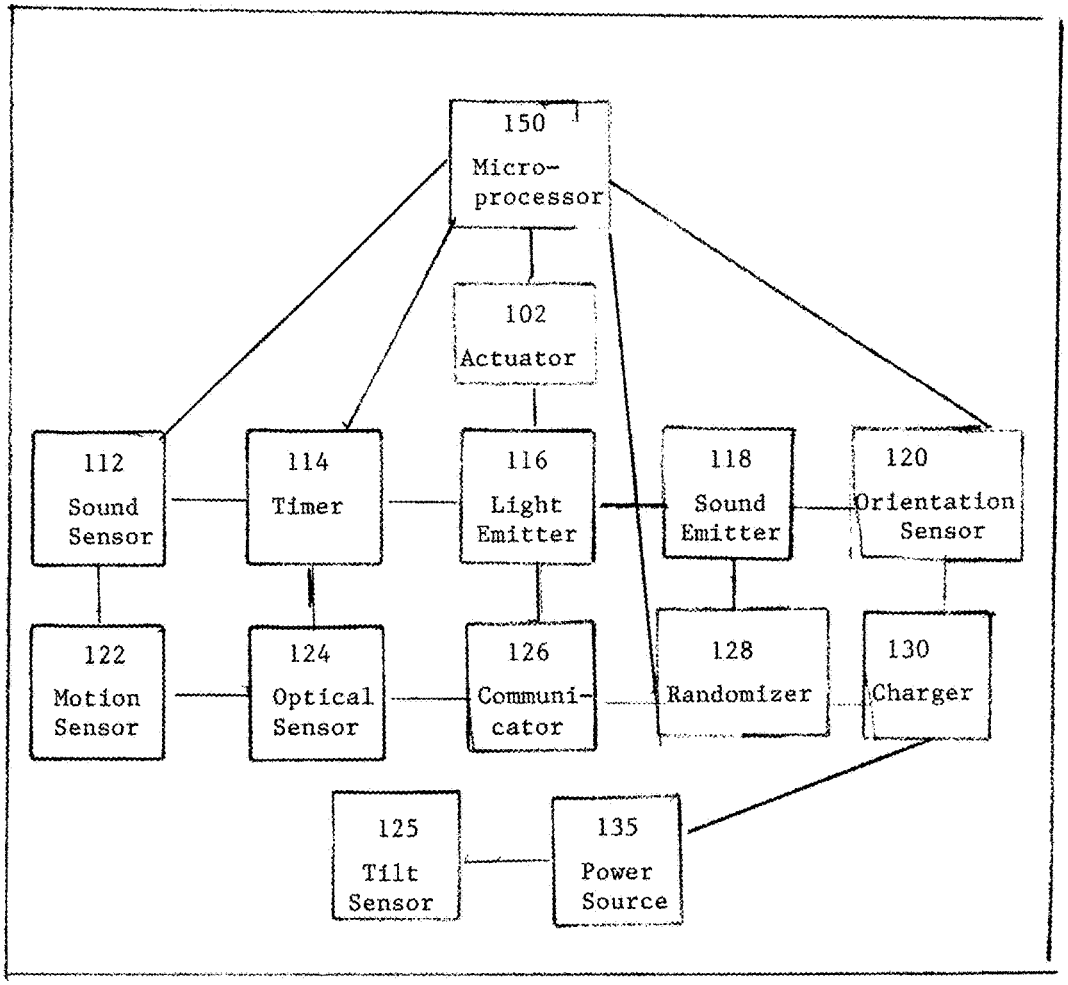
FIG. 2 is a block diagram of the embodiment of FIG. 1, showing the electronic components included in the device.

Referring to FIG. 1, an embodiment of the present invention, sided device 100 is shown. The device 100 includes a housing 101 that can be in the form of any shape, such as a sphere, an oval, or multi-sided form ranging from a triangle, square, rectangle, to any number of sides. The device 100 in alternate embodiments could be configured in the shape of a character, such as an animal, a person, a design of a fictional character or the like. In the embodiment shown the sided device 100 is represented as a standard die, comprising six (6) sides 103. The sides include indicia 105, indicating numbers, for example only, on the die's surfaces 103. Indicia such as letters, pictures, or other images and the like can be used separately or in combination with or instead of numbers, depending upon the ultimate use of the device. Shown in phantom is a plurality of light emitters (or light sources) 116, such as light emitting diodes, discussed in further detail below. In the embodiment shown in FIG. 1, the sides 103 are translucent. In other embodiments, the sides 103 could be transparent or solid, or a combination of solid, transparent and/or translucent.

The device includes an actuator 102. Actuator 102 may be any actuator or motor known in the art. More specifically, actuator 102 can cause sided device 100 to move, or facilitate the motion of sided device 100, such as for rotation, turning, spinning, flipping, sliding on a surface and/or leaping from a surface. Although not specifically shown in the drawings, it is to be understood that the actuator 102, the various electronic components described below, the integrated circuit 140 and a microprocessor 150 are in electronic communication with each other. Factors such as the force exerted by the actuator 102 and the sensitivity of the actuator 102 are determined by how the microprocessor 150 is programmed.

In some embodiments it is desired for the motion of sided device 100 to change in direction, such as to increase or decrease the chances of sided device 100 rolling onto or turning to a specific side, or such as to facilitate sided device 100 moving in a specific direction. Additionally or alternatively, in some embodiments it is desired for the motion of sided device 100 to change in speed or distance, such as to distinguish between different types of rotation scenarios. Accordingly, in certain embodiments, actuator 102 can determine, or control, or influence, and/or change any of the direction and speed and distance of the motion of sided device 100. For example, actuator 102 may be a motor which spins in one direction for one second and then spins in the opposite direction for two seconds.

In some embodiments, sided device 100 includes sound sensor 112. Sound sensor 112 may be any sensor, or sensor mechanism and/or sensing process, or detector, or receiver, or recorder, of sound or sound waves or sound signals or vibrations in air, as known in the art. More specifically, sound sensor 112 can sense or detect or record sound, such as hand clapping, finger "snapping", a door slam, a dog bark, a voice, and/or tones (e.g. tones generated by a computer or mobile device). The sound sensor 112 can respond to sound frequencies ranging from about 50 Hz to about 50,000 Hz. The sensitivity of the sound sensor 112 can be programmed so that it recognizes sounds above a specific sound level (for example, greater than 10 but less than 75 decibels), or within or above a certain frequency or range of frequencies, for example. In embodiments, the transmitted sound can be at frequencies, such as low frequencies, or high frequencies, that are inaudible to most humans.

In certain embodiments, sound sensor 112 and/or information or indications from sound sensor 112 may control, or set, or influence actuator 102 of sided device 100, and/or the operation of actuator 102, such as controlling whether actuator 102 is activated and/or deactivated, or such as setting the direction of the spinning of actuator 102, in case actuator 102 is a motor. For example, sound sensor 112 may detect the sound of hands clapping which causes actuator 102 to activate (e.g. start moving). For another example, sound sensor 112 may record sounds, whereas the recording of the sounds from sound sensor 112 may be analyzed by any component or part of sided device 100 to identify the sound of fingers snapping, such as known to those skilled in the art of sound recognition, and in the example where the sound of fingers snapping is identified, actuator 102 is commanded to prompted to deactivate or stop its operation (e.g. stop moving).

In certain embodiments, sound sensor 112 can distinguish between different sounds as different inputs or different commands that control, or set, or influence any other part or component of sided device 100. Similarly, information from sound sensor 112 can be used or utilized to distinguish between different sounds as different inputs or different commands that control, or set, or influence any other part or component of sided device 100.

In some embodiments, sided device 100 includes timer 114. Timer 114 may be any mechanism and/or process and/or means, physical and/or electronic and/or computational, which can measure and/or keep track of and/or indicate and/or count down and/or set, time and/or a time period, and/or a beginning and/or end of a time period, as known in the art. Timer 114 may be mechanical or digital or a program or software or procedure executed by a computer or processor, as known in the art.

In certain embodiments, timer 114 of sided device 100 can control, or set, and/or influence the operation of, and/or activate and deactivate, actuator 102, such as by measuring and/or setting a period of time actuator 102 is operating and/or is not operating, or such as by indicating the beginning and/or end of a time period for actuator 102 to be active or not active. For example, timer 114 can provide or produce information which causes actuator 102 to start rotating, and after a period of time, measured by timer 114, provide or produce additional information which causes actuator 102 to stop rotating, or to rotate slower, or in a different direction.

In certain embodiments, timer 114 of sided device 100, and/or information therefrom, can control, or set, and/or influence the operation of, and/or activate and deactivate, sound sensor 112 of sided device, such as by measuring and/or setting a period of time sound sensor 112 is operating and/or is not operating, or such as by indicating the beginning and/or end of a time period for sound sensor 112 to be active or not active. For example, timer 114 can provide or produce information which causes sound sensor 112 to start recording sound, and after a period of time, measured by timer 114, provide or produce information which causes sound sensor 112 to stop recording sound In certain embodiments, sound sensor 112 of sided device 100, and/or the information communicated from it, can control, or set, and/or influence the operation of, and/or activate and deactivate, the timer 114.

In some embodiments, sided device 100 includes a light emitter 116. Light emitter 116 may be any mechanism and/or process and/or means, physical and/or electronic, which can emit and/or generate and/or produce light or light waves, as known in the art. Optionally, light emitter 116 can emit and/or generate and/or produce light or light waves of one or more different colors or wavelengths. For example, in the embodiment shown in the drawings, the light emitter 116 is a Light Emitting Diode ("LED"), or it can be an array of multiple LEDs. For another example, light emitter 116 may be a small display which can generate visible images, such as a liquid crystal display ("LCD") or an organic light emitting diode ("OLED") screen. The light emitters 116 can be all of the same color, or a variety of colors.

In certain embodiments, timer 114 of sided device 100, and/or information therefrom, can control, or set, and/or influence the operation of, and/or activate and deactivate, light emitter 116.

In certain embodiments, sound sensor 112 of sided device 100, and/or information therefrom, can control, or set, and/or influence the operation of, and/or activate and deactivate, light emitter 116.

In some embodiments, sided device 100 includes a sound emitter 118. Sound emitter 118 may be any mechanism and/or process and/or means, physical and/or electronic, which can emit and/or generate and/or produce sound or sound waves, as known in the art. Optionally, sound emitter 118 can emit and/or generate and/or produce sound or sound waves of any frequency and/or length and/or combination and/or order. For example, sound emitter 118 may be a sound speaker which can generate audible music or musical notes or voice.

In certain embodiments, timer 114 of sided device 100, and/or information therefrom, can control, or set, and/or influence the operation of, and/or activate and deactivate, sound emitter 118.

In certain embodiments, sound sensor 112 of sided device 100, and/or information therefrom, can control, or set, and/or influence the operation of, and/or activate and deactivate, sound emitter 118.

In some embodiments, sided device 100 includes an orientation sensor 120. Orientation sensor 120 may be any sensor, or sensor mechanism and/or sensing process, or detector, or receiver, or recorder, of the orientation of sided device 100, and/or of the direction of sided device 100 relative to the ground and/or any other device or object, as known in the art. For example, orientation sensor 120 can ascertain or detect which side sided device 100 is at the top and which is at the bottom when the sided device is resting on a table or relative to the ground, such as in case orientation sensor 120 is or includes a gyroscope.

In embodiments, the orientation sensor 120 can be a tilt sensor, and detect the degree to which the device 100 has been tilted with respect to a given surface. In other embodiments, the tilt sensor 125 can be a component separate from and/or cooperating with, the orientation sensor 120.

In certain embodiments, timer 114 of sided device 100, and/or information therefrom, can control, or set, and/or influence the operation of, and/or activate and deactivate, orientation sensor 120.

In certain embodiments, sound sensor 112 of sided device 100, and/or the information communicated from it, can control, or set, and/or influence the operation of, and/or activate and deactivate, the orientation sensor 120.

In certain embodiments, orientation sensor 120 of sided device 100, and/or information therefrom, can control, or set, and/or influence the operation of, and/or activate and deactivate, actuator 102 and/or sound sensor 112 and/or timer 114, and/or sound emitter 118 and/or light emitter 116.

In some embodiments, sided device 100 includes motion sensor 122. Motion sensor 122 may be any sensor, or sensor mechanism and/or sensing process, or detector, or receiver, or recorder, of motion, and/or properties of motion, of sided device 100, as known in the art. More specifically, motion sensor 122 can sense and/or detect and/or measure and/or keep track of and/or indicate and/or ascertain any motion, or lack thereof, of sided device 100, and/or properties of motion of sided device 100, such as speed, rotation direction, duration and the like. For example, motion sensor 122 may be an accelerometer.

In certain embodiments, timer 114 of sided device 100, and/or information therefrom, can control, or set, and/or influence the operation of, and/or activate and deactivate, motion sensor 122.

In certain embodiments, motion sensor 122 of sided device 100, and/or information therefrom, can control, or set, and/or influence the operation of, and/or activate and deactivate, actuator 102 and/or sound sensor 112 and/or timer 114.

In some embodiments, sided device 100 includes an optical sensor (light sensor) 124. Optical sensor 124 may be any sensor, or sensor mechanism and/or sensing process, or detector, or receiver, or recorder, of light or light waves and/or images and/or visual gestures and/or optical signals, as known in the art. For example, optical sensor 124 may be a camera or include a camera.

In certain embodiments, timer 114 of sided device 100, and/or information therefrom, can control, or set, and/or influence the operation of, and/or activate and deactivate, optical sensor 124.

In certain embodiments, optical sensor 124 of sided device 100, and/or information therefrom, can control, or set, and/or influence the operation of, and/or activate and deactivate, actuator 102 and/or sound sensor 112 and/or timer 114 and/or motion sensor 122 and/or orientation sensor 120.

In some embodiments, sided device 100 includes communicator 126. Communicator 126 may be any mechanism and/or process and/or means, physical and/or electronic and/or computational, which facilitates communication between sided device 100, or any part or component thereof, and any other device and/or system and/or communicator, as known in the art. More specifically, communicator 126 may be or include a transmitter and/or receiver of signals, such as electromagnetic wireless transmissions in a network of devices.

In certain embodiments, timer 114 of sided device 100, and/or information therefrom, can control, or set, and/or influence the operation of, and/or activate and deactivate, communicator 126.

In certain embodiments, optical sensor 124 of sided device 100, and/or information therefrom, can control, or set, and/or influence the operation of, and/or activate and deactivate, actuator 102 and/or sound sensor 112 and/or timer 114 and/or motion sensor 122 and/or orientation sensor 120 and/or optical sensor 124.

In some embodiments, sided device 100 includes randomizer 128. Randomizer 128 may be any mechanism and/or process and/or means, physical and/or electronic and/or computational, which can create random values, such as for any process or computation by any component or part of sided device 100. Randomizer 128 may be mechanical or digital component or a program or software or procedure executed by a computer or processor, as known in the art.

In certain embodiments, randomizer 128 of sided device 100, and/or information therefrom, can control, or set, and/or influence the operation of, and/or be used by the operation of, timer 114, such as to produce random time periods to be measured by the timer. For example, randomizer 128 may generate or produce a random number, whereas the random number is used or utilized to set a number of seconds for timer 114 to track.

In some embodiments, sided device 100 includes a charger 130. Charger 130 may be any mechanism and/or process and/or means, physical and/or electronic and/or computational, which facilitates the transferring of power or electricity to a power source 135 (e.g. a battery) of the device 100, or facilitates the charging of a power source of the device 100 with power or electricity, as known in the art. For example, charger 130 may be an array of contacts or sockets that can connect to a source of electricity. Two contacts are required for each device 100 to be charged, one contact being a positive pole and the second contact being the negative pole.

Figure 3:
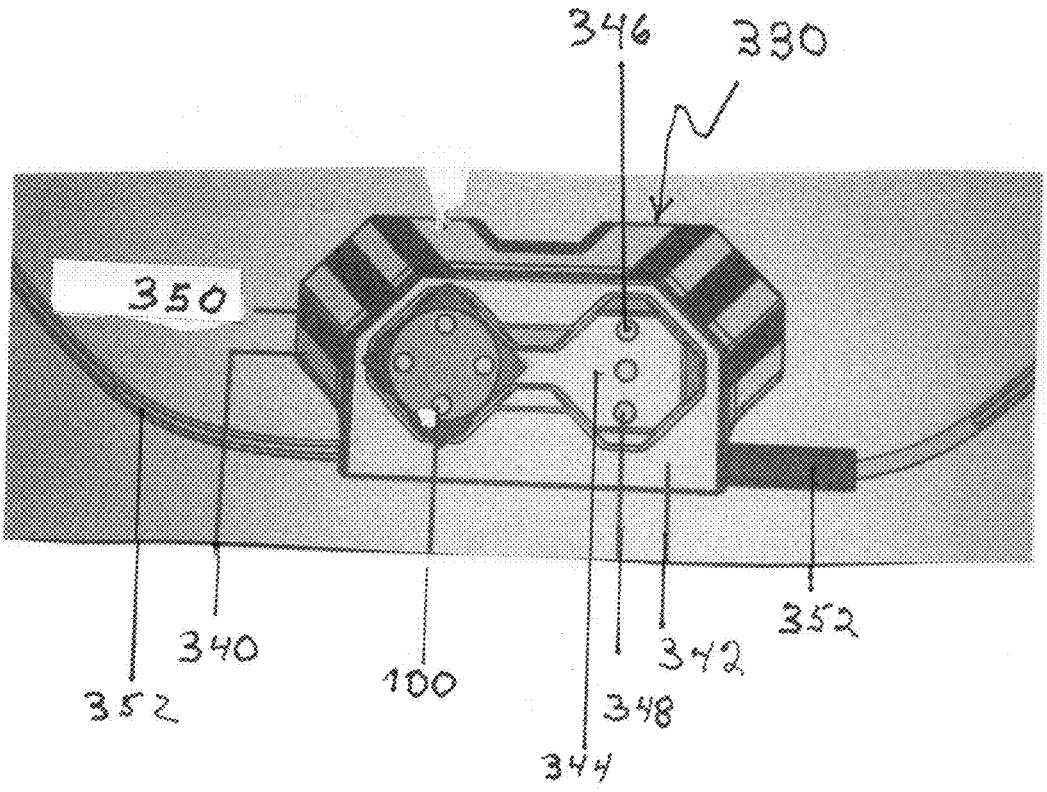
FIG. 3 is a top plan view of the charging device, with a device of the present invention in one of the charging ports.
Figure 4:
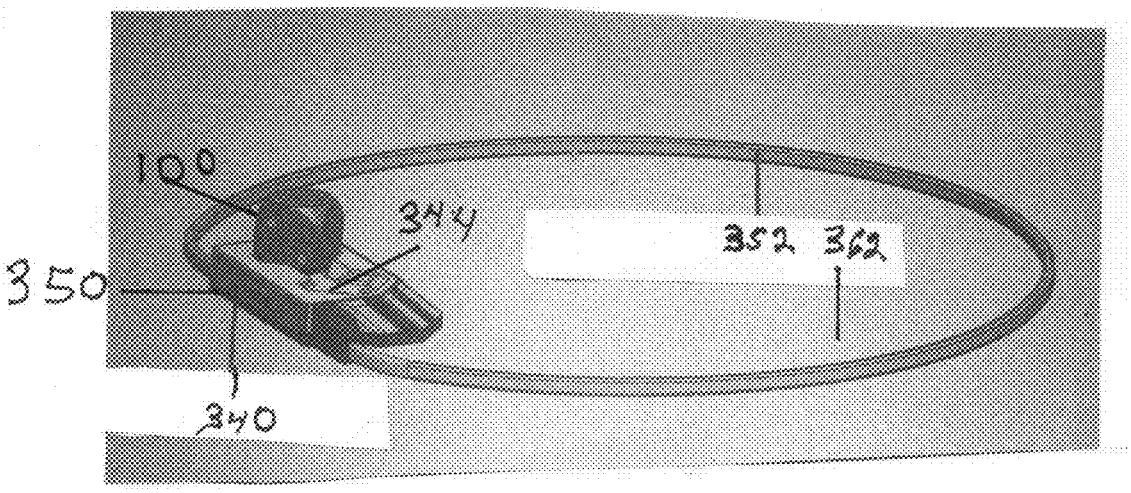
FIG. 4 illustrates the power cord of the charging device, connected to the charging device to form an enclosed area.

An embodiment of an external charging device 330 is shown in FIGS. 3-4. External charging device 330 comprises a housing 340 that is attached to base 350 by a plurality of fasteners (not shown). In the embodiment shown, the fasteners are screws, but other fasteners known to those skilled in art, such as a nut and bolt, rod, a rivet, cotter pin, staple, or the like, can be substituted for the screws. The fastener could also be an adhesive, a hook and loop fastener, or the base and housing can be joined by other means of joining known in the plastics industry, such as by ultrasonic welding and the like.

Housing 340 includes an upper surface 342 containing a charge port 344. In the embodiment in FIG. 3, two charge ports 344 are present. Each charge port 344 includes several openings 346, through which opening 346 a charge contact 348 is mounted. One charge contact 348 is a positive pole, and another charge contact 348 is a negative pole. A power cord 352 connects the external charger 330 to a source of electrical power, either AC or DC, depending upon the country of use, or can connect the charging device 330 to another device, such as a laptop or desktop computer (not show), or as shown in FIG. 4, to connect "back" to the charging device, forming an enclosed area 362. The enclosed area 362 can be utilized as a confined area for the device 100 to roll in, with the cable 352 forming a barrier to contain the movement of device 100, or used as an obstacle for the device 100 to jump over. In the embodiment shown in FIG. 4, cable 352 is a USB ("Universal Serial Bus") cable, although other cables could be substituted therefor.

When the device 100 is inserted into a charge port 344, the device 100 is held in position by a clamp 354 which is activated as the device 100 is pushed into place in the charge port 344. The clamp 354 is a lever-like mechanism towards the base of each charge port 344 so that as the device 100 is urged in contact with a first end 356 of the clamp 354, the first end 356 is pushed down and second end 358 is urged upward and contacts the device 100 to hold the device 100 within the charge port 344. In embodiments, the charge port 344 may cover a portion of the device 100, or the charge port 344 may be sufficiently deep so as to enclose the device 100 within the charge port 344.

The electronic circuitry of external charger 330 is connected to a printed circuit board that is contained within the housing 340; the circuitry is not shown because it comprises known electronic components.

In the embodiment shown in FIG. 1, the device 100 is represented as a standard die, comprising six (6) sides 103. The sides include indicia 105, such as one or more dots to indicate numbers, for example only, on the die's surfaces 103. These indicia 105 (or markings) include contact points (or connectors) 348 that are generally flat and can be flush with the device's surfaces 103. In embodiments, these contact points 348 may be dimpled, or be either depressed or elevated. The extent of the depression or elevation will depend upon the ultimate final embodiment. In the example shown in the drawings, the depression or elevation can be up to about 3 millimeters. These contact points 348 not only facilitate charging the device 100, and can facilitate data transfer as well, when placed in contact with their corresponding contact points in the charging device 330.

In one embodiment, charger 130 includes flat connectors which are aligned to any side of sided device 100. It is desired that the object have identical sides, such as in size and all having a flat surface, such as known in the art for dice in the field of games.

In an alternate embodiment, the charger 130 could be a wireless charging device, such that the sided device 100 can be positioned on a wireless charging device, such as a wireless charging pad or similar device, known to those skilled in the art, for example only and not limited to, such as those made by Samsung Electronics or Lenovo Corp., and the sided device 100 can be charged without it being wired to a charger.

In some embodiments, any of sound sensor 112 and timer 114 and light emitter 116 and sound emitted 118 and orientation sensor 120 and motion sensor 122 and optical sensor 124 and communicator 126 and randomizer 128 and charger 130 are included in integrated circuit 140, as known in the art for integrated circuits.

It is to be understood that any of sound sensor 112 and timer 114 and light emitter 116 and sound emitted 118 and orientation sensor 120 and motion sensor 122 and optical sensor 124 and communicator 126 and randomizer 128 and charger 130, and/or information therefrom, may be part of, or included in, any processing or computation of, in or by any part or component of sided device 100, such as by a processor 150 of the sided device.

It is also to be understood that any of sound sensor 112 and timer 114 and light emitter 116 and sound emitted 118 and orientation sensor 120 and motion sensor 122 and optical sensor 124 and communicator 126 and randomizer 128 and charger 130, and/or information therefrom, may control or influence or set or change the operation of any other of sound sensor 112 and timer 114 and light emitter 116 and sound emitted 118 and orientation sensor 120 and motion sensor 122 and optical sensor 124 and communicator 126 and randomizer 128 and charger 130.

The device 100 includes actuator 102, which is positioned inside of the device 100 diagonally to sides 103. In one embodiment, actuator 102 of the device 100 is positioned or installed inside the device 100 such that its axis of motion is diagonal to any number of sides 103 of the device 100, in any number of geometric planes. The position or installation of actuator 102 diagonally to any number of sides of sided device 100 facilitates certain motions of the device 100, such as motions which increase the number of bounces or leaps or flips the sided device performs.

To use the device 100 of the present invention, the device 100 is first charged using charger 130. The device 100 is positioned within a charging slot, or the charger 130 is connected to the device 100, the charger 130 connected to an external source of power, and the device 100 charged for a time period sufficient to charge the battery 135.

Figure 5:
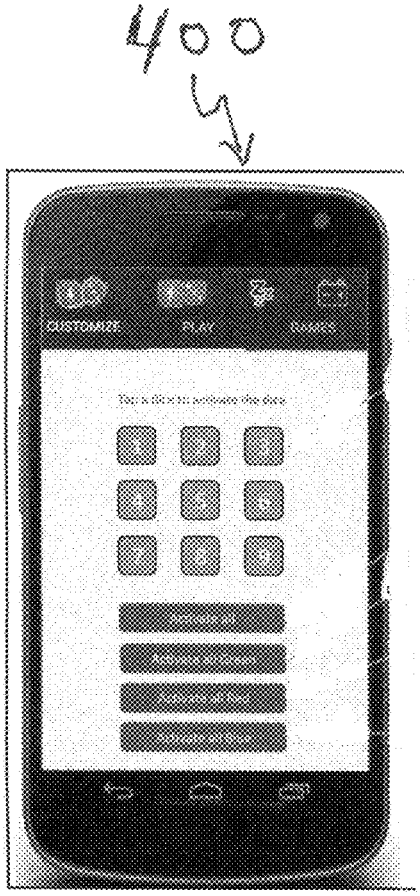
FIG. 5 shows an embodiment of the present invention being programmed by communication from a smartphone.
Figure 5:
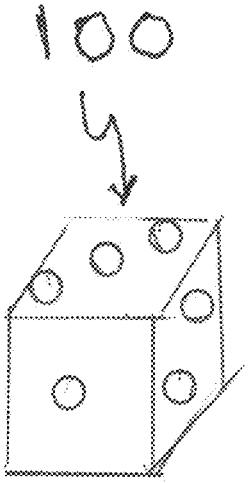

The microprocessor 150 of the device 100 is programmed by instructions sent from a programming device 400 (FIG. 5). The programming device 400 can be a computer, tablet computer, smart phone or similar device that can produce and transmit sound signals detected by the device's sound sensor 112, which communicates those instructions to the microprocessor 150 and/or the appropriate component of device 100. Programming of the device could also be done by transmitting the signals using a cable connecting the device 100 with the programming device. Indicia shown on the device 400 are for illustrative purposes only.

In one embodiment of the present invention, the device 100 is programmed wirelessly using a smartphone with an application for programming the device 100. Wireless programming can be done within a range from about 1 millimeter to about 3 meters. Wireless programming can also be done within a range from about 10 millimeters to about 3 meters. Wireless programming can be done within a range from about 50 millimeters to about 2 meters. Wireless programming can also be done within a range from about 100 millimeters to about 1 meter.

The device 100 is turned on, or "brought to life" (if it had been in a sleep mode), by tapping it against a surface 2-3 times. The tapping motion activates the actuator 102. When the user makes a sound, such as clapping, or a finger snap, the sound sensor 112 receives the sound, and causes the device 100 to respond. Depending upon how the device 100 has been programmed, the device 100 may be caused to rotate, turn, jump, flip, leap, reverse direction, bounce, hop, slide, stop or other movements.

The device 100 can be programmed so that it is distributed with a set of default behaviors. Examples of some of these default behaviors include:

Behavior 1: Upon activation, rotate in direction X for 3 seconds, and activate LEDs in red for this 3 second period; rest for 4 seconds; listen for sounds of clapping for 10 seconds; if clapping is detected within the 10 second period, then rotate for 2 seconds in direction Y, and then stop. If a first sequence of tones (ex, A-B-C-D) is then detected within 5 seconds, proceed to behavior 2. If a second sequence of tones (ex, A-B-S-D-T) is detected, proceed to behavior 3

Behavior 2: In response to first sequence of tones (A-B-C-D), jump once, then stop for 10 seconds and await further commands. If no further commands in 15 seconds, turn device off.

Behavior 3: In response to second sequence of tones (A-B-S-D-T), jump once, with LEDs in green, then rotate in direction Z for 10 seconds, stop for 2 seconds, then rotate in direction X for 2 second, stop and await further commands. If no further commands in 15 seconds, turn device off.

The sensitivity of the device 100 can be adjusted by the user, or can be determined by how the microprocessor 150 is programmed. The device 100 can be actuated by a sound as close as about 1 mm to distances as far as about 30 meters. In embodiments, the device 100 can be actuated by a sound within a range of about 10 mm to about 20 meters. In other embodiments, the device 100 can be actuated within a range of about 50 mm to about 10 meters. In other embodiments, the device 100 can be actuated within a range of about 100 mm to about 5 meters. In other embodiments, the device 100 can be actuated by a sound within a range of about 150 mm to about 1 meter.

Having the actuator 102 mounted at an angle with respect to the sides 103 of the device facilitates movement of the device 100. In embodiments, the actuator 102 can be mounted at an angle ranging from about 1 degree to about 89 degrees. In other embodiments, the actuator 102 can be mounted at an angle ranging from about 15 degrees to about 75 degrees. In other embodiments, the actuator 102 can be mounted at an angle ranging from about 35 degrees to about 55 degrees. In other embodiments, the actuator 102 is mounted at an angle ranging from about 40 degrees to about 50 degrees.

As described earlier, the device 100 of the present invention can be configured in any number of shapes, including those of spheres, characters or animals. In those embodiments, which may or may not have defined sides with which to mount the actuator at an angle, an internal frame could be supplied within the embodiment. In such an embodiment, the internal frame, for example, a cube, can be mounted within the embodiment and positioned so that it is in contact with the outside wall of the embodiment, and the actuator 102 mounted at an angle to the sides of the frame. The microprocessor and other system electronics can be mounted at any location in the embodiment that is most convenient. With the actuator 102 thus mounted at an angle with respect to an internal frame, other embodiments of the device cold behave in manners similar to the operation of the dice embodiment 100.

In embodiments, the device 100 can be used as a stand-alone unit, packaged with other dice having an identical configuration or a different configuration (indicia on a second die being different from indicia on first die), or packaged with a different item, such as a game, a deck of cards, tool, a foodstuff or the like. The device 100 can also be distributed with an external charger.

We claim:

1. A sided device comprising:

A housing, the housing including a plurality of sides to form an enclosure, the housing further including a plurality of components, comprising:

an actuator;

a sound sensor;

a light emitter;

a timer;

a randomizer;

a microprocessor; and a source of electric power;

the actuator and microprocessor in electronic communication with the sound sensor, the light emitter, the timer, the randomizer and the source of electric power, wherein the force, speed and/or direction of the actuator is determined by one or more of the sound from an external source, the timer and the randomizer; the actuator having a movable end, the actuator mounted within the enclosure and positioned such that when actuated, the movable end contacts a side, causing movement of the sided device; the actuator positioned within the housing and at an angle, the angle ranging from 1 degree to 89 degrees, with respect to the sides proximate the ends of the actuator.

2. The device as described in claim 1, wherein when the sound sensor detects a sound, one or more of the sound sensor, the timer and the randomizer communicates timer communicates with the microprocessor which communicates with the light emitter to emit light in one or more of a plurality of colors.

3. The device as described in claim 1, wherein the sensitivity of one or more of the sound sensor and motion sensor is determined by a communication from one or more of the sound sensor, the timer, the randomizer and the motion sensor to the microprocessor.

4. The device as described in claim 3, wherein the movement is chosen from the group consisting of a rotation, a turn, a flip, a jump, a leap, a reversal, a hop, a slide and a stop.

5. The device as described in claim 2, wherein the device is programmed by sound transmitted from an external means for programming.

6. The device as described in claim 5, wherein the device is positioned within a second housing, the second housing being chosen from the group consisting of a sphere, an oval, an ellipse, a polygon, a prolate spheroid, an oblate spheroid, an animal, a shape of a person, a design of a fictional character, a mineral and a plant.

7. A game system comprising:

a pair of sided devices, each sided device comprising:

A housing, the housing including a plurality of sides to form an enclosure, the housing further including a plurality of components, comprising:

an actuator;

a sound sensor;

a light emitter;

a timer;

a randomizer;

a microprocessor; and a source of electric power;

the actuator and microprocessor in electronic communication with the sound sensor, the light emitter, the timer, and the source of electric power; the actuator having a movable end, the actuator mounted within the enclosure and positioned such that when actuated, the movable end contacts a side, causing movement of the sided device; the actuator positioned within the housing and at an angle, the angle ranging from 1 degree to 89 degrees, with respect to the sides proximate the ends of the actuator; and a means for charging the source of electric power, and wherein the device is positioned within a second housing, the second housing being chosen from the group consisting of a sphere, an oval, an ellipse, a polygon, a prolate spheroid, an oblate spheroid, an animal, a shape of a person, a design of a fictional character, a mineral and a plant.

8. The game system as described in claim 7, wherein the sides comprise one or more contacts and/or sockets, and the one or more contacts are flush with the side of the device.

9. The game system as described in claim 8, wherein the device is programmed by sound transmitted from an external means for programming.

10. The game system as described in claim 9, wherein the movement is chosen from the group consisting of a rotation, a turn, a flip, a jump, a leap, a reversal, a hop, a slide and a stop.

11. The device as described in claim 2, wherein the sides comprise one or more contacts and/or sockets, and the one or more contacts are flush with the side of the device.

* * * * *